US007654579B2

(12) United States Patent
Hansen

(10) Patent No.: US 7,654,579 B2
(45) Date of Patent: Feb. 2, 2010

(54) OBJECT OF VALUE COMPRISING A MOIRÉ PATTERN

(75) Inventor: Achim Hansen, Zug (CH)

(73) Assignee: OVD Kinegram AG, Zug (CH)

( * ) Notice: Subject to any disclaimer, the term of this patent is extended or adjusted under 35 U.S.C. 154(b) by 164 days.

(21) Appl. No.: 10/589,178

(22) PCT Filed: Feb. 12, 2005

(86) PCT No.: PCT/EP2005/001428

§ 371 (c)(1),
(2), (4) Date: Aug. 11, 2006

(87) PCT Pub. No.: WO2005/078669

PCT Pub. Date: Aug. 25, 2005

(65) Prior Publication Data

US 2007/0177131 A1 Aug. 2, 2007

(30) Foreign Application Priority Data

Feb. 16, 2004 (DE) ..... 10 2004 007 379

(51) Int. Cl.
*B42D 15/10* (2006.01)
*B42D 15/00* (2006.01)

(52) U.S. Cl. ..... 283/72; 283/74; 283/94; 283/98; 283/57; 283/117; 283/901; 283/114; 283/100; 283/88; 283/89

(58) Field of Classification Search ..... 252/79.5; 283/74, 82, 87, 88, 89, 91, 94, 98, 107, 108, 283/109, 110, 111, 113; 359/619, 622, 623, 359/626; 430/275, 276, 278, 290; 40/427; *B29C 59/04; B29D 7/00, 11/00, 31/00; B41F 13/02; B42D 15/00; B44B 5/00; B44F 1/00; D21H 21/40, 21/48; G06K 19/14, 19/16; G07D 7/00, 7/12; G09F 3/02*
See application file for complete search history.

(56) References Cited

U.S. PATENT DOCUMENTS

| | | | | |
|---|---|---|---|---|
| 3,862,501 | A | 1/1975 | Jemseby et al. | |
| 4,892,336 | A * | 1/1990 | Kaule et al. | 283/91 |
| 5,176,405 | A | 1/1993 | Kaule et al. | |
| 5,712,731 | A * | 1/1998 | Drinkwater et al. | 359/619 |
| 6,381,071 | B1 | 4/2002 | Dona et al. | |
| 2002/0027361 | A1 * | 3/2002 | Hardwick et al. | 283/72 |
| 2003/0003323 | A1 * | 1/2003 | Murakami et al. | 428/690 |
| 2003/0137145 | A1 * | 7/2003 | Fell et al. | 283/72 |
| 2003/0161017 | A1 | 8/2003 | Hudson et al. | |
| 2004/0084893 | A1 | 5/2004 | Fan et al. | |

FOREIGN PATENT DOCUMENTS

| | | | |
|---|---|---|---|
| DE | 3208204 | A1 | 9/1983 |
| DE | 102 22 817 | A1 | 7/2003 |
| EP | 0279 526 | | 8/1988 |
| RU | 2053558 | C1 | 1/1996 |
| RU | 2102246 | C1 | 1/1998 |
| WO | WO 98/15418 | | 4/1998 |
| WO | WO 99/01291 | | 1/1999 |

OTHER PUBLICATIONS

Rudolf L. van Renesse, "Optical Document Security," Second Edition, pp. 274-287, Artech House, 1998.

Rudolf L. van Renesse, "Optical Document Security," Second Edition pp. 364-369, Artech House, 1998.

* cited by examiner

*Primary Examiner*—Dana Ross
*Assistant Examiner*—Justin V Lewis
(74) *Attorney, Agent, or Firm*—Hoffmann & Baron, LLP

(57) ABSTRACT

The invention concerns an object of value (15), for example a credit card, banknote or identity card. The object of value (15) has a carrier layer (1), at least one first layer (21) containing a moiré pattern and at least one second layer (31, 33) containing a moiré analyzer for the moiré pattern of the first layer (21). That second layer is arranged above or beneath the first layer in a fixed position relative to the first layer in such a way that the moiré pattern of the first layer (21) and the moiré analyzer of the second layer (31, 33) are permanently optically superimposed at least in region-wise fashion, whereby a permanent moiré image is generated.

15 Claims, 4 Drawing Sheets

OBJECT OF VALUE COMPRISING A MOIRÉ PATTERN

This application claims priority based on an International Application filed under the Patent Cooperation Treaty, PCT/EP2005/001428, filed on Feb. 12, 2005 and German Application No. 102004007379.1-45, filed on Feb. 16, 2004.

BACKGROUND OF THE INVENTION

The invention concerns an object of value, for example a credit card, a banknote or an identity card, comprising a carrier layer, for example a paper carrier, and at least one optical security element which is disposed on the carrier layer and which has a first layer containing a moiré pattern.

Moiré effects occur in a large number of natural and artificial structures. In addition the use of moiré structures as a security element in the area of production and use of banknotes is known.

Thus for example EP 0 930 979 B1 describes a banknote having two mutually spaced transparent windows. A first transparent window which is substantially free from an identification character includes a first moiré-inducing pattern comprising a set of closely spaced fine lines. A second transparent and substantially identification-free region of the banknote contains a second moiré-inducing pattern which also comprises a set of closely spaced fine lines. The fine lines of the first moiré-inducing pattern are arranged in substantially mutually parallel relationship in a transverse direction transversely across the banknote. The fine lines of the second moiré-inducing pattern extend in substantially mutually parallel relationship in the direction of the longitudinal axis. If the banknote is folded over itself along a predetermined fold line, then the first and the second regions are brought into alignment and in that way the moiré-inducing patterns of those regions are superimposed. Upon viewing in transmitting light, with such a superimposition, it is possible to see a series of dark bands which extend diagonally on the folded banknote and which are also known as Talbot stripes.

The second moiré-inducing pattern is accordingly used as an analyser for demonstrating the latent moiré image contained in the first moiré-inducing pattern.

SUMMARY OF THE INVENTION

The invention is now based on the problem of providing a novel and improved moiré-based security feature.

That object is attained by an object of value, in particular a security document, which has a carrier layer, at least one optical security element which is disposed on the carrier layer and which has a first layer containing a moiré pattern, and a second layer which contains a moiré analyser for the moiré pattern of the first layer and which is arranged above or below the first layer in a fixed position relative to the first layer in such a way that the moiré pattern of the first layer is permanently optically superimposed at least in region-wise manner with the moiré analyser of the second layer, whereby a permanent moiré image is generated.

A novel moiré image of that kind can be used as a security element in the field of production and use of banknotes, personal and identification documents, value-bearing documents as well as product and article security. Use in the decorative field and in advertising are also possible. In this respect the term moiré pattern is used to denote a pattern which is formed from repeating structures and which, upon superimposition with or in a condition of viewing through a further pattern which is formed by repeating structures and which acts as a moiré analyser, shows a new pattern, namely a moiré image, which is concealed in the moiré pattern. In the simplest case that moiré effect arises out of the superimposition of dark and light stripes which are arranged in accordance with a line grid, wherein that line grid is phase-shifted in region-wise manner to produce the moiré image. Besides a linear line grid it is also possible for the lines of the line grid to have curved regions and to be arranged for example in wave-shaped or circular configuration. In addition it is also possible to use a moiré pattern which is constructed on two or more line grids which are rotated relative to each other or which are in superimposed relationship. Decoding of the moiré image in such a line grid is also effected by region-wise phase displacement of the line grid, in which case two or more different moiré images can be encoded in such a moiré pattern. In addition the use of moiré patterns and moiré analysers is also possible, which are based on so-called 'Scrambled Indicia®' technology or on a hole pattern (round, oval or angular holes of varying configurations).

One or more permanently present moiré images can be integrated into an object of value according to the invention and optionally combined with latent moiré images and/or separate moiré analysers. The invention avoids the disadvantages of the above-described moiré-based security elements: it is no longer necessary to use a system with at least two separate objects. In many cases, such a system with separate objects has been found to be impracticable in use and gave rise to serious costs. Thus for example the production of banknotes which have two spaced transparent regions with a moiré pattern on the one hand and a moiré analyser on the other hand is technically very complicated and cost-intensive. In addition that also requires active superimposition of the latent moiré image and the analyser. In contrast thereto the invention provides an inexpensive security feature which however is very difficult to imitate and which is further distinguished by a high level of user-friendliness.

Advantageous configurations of the invention are set forth in the appendant claims.

It is on the one hand possible for the first layer and the second layer to be arranged on the same side of the carrier layer so that the permanent moiré image is visible when viewed in incident light. It is particularly advantageous however for the first layer and the second layer to be arranged on opposite sides of the carrier layer so that the permanent moiré image is visible only when viewed in transmitted light. Viewing in incident light thus provides the viewer with a different item of optical information, than is the case when viewing in transmitted light. That provides an easily checkable security feature.

It is advantageous in that respect to use moiré patterns which have an extremely sensitive reaction to displacement of the moiré analyser both in the x and also in the y direction. Such moiré patterns are based for example on curved line grids or two or more mutually superimposed line grids. Both application of the first and second layers to the same side of the carrier layer and also application of the first layer to the first side and the second layer to the other side of the carrier layer, in relation to moiré patterns of that kind, requires a high level of register accuracy for the transfer or printing processes used for that purpose, as just slight deviations can lead to a considerable falsification of the moiré image. In particular accurate-register printing on both sides imposes considerable demands (super-simultaneous printing) so that imitation of that security feature is possible only with very great difficulty. Furthermore high demands are also made on the process for generating the moiré pattern and/or the moiré analyser as just slight deviations, for example in line tracing, can markedly alter the resulting moiré pattern.

There is however also the possibility of using a moiré pattern which is tolerant in one or more directions in relation to displacement of the moiré analyser so that the object of value can be particularly inexpensively produced.

It is particularly advantageous if the object of value has two or more second layers which each contain a moiré analyser for the moiré pattern of the first layer. Those layers are arranged in mutually superposed relationship in such a way that the moiré patterns of the first layer and the moiré analysers of the second layer are permanently optically superimposed at least in region-wise manner, whereby two or more permanent moiré images are generated. The level of safety against forgery is further increased by that procedure. When that procedure is adopted it is then also possible for the one moiré analyser to be arranged on the one side of the carrier layer and for the other moiré analyser to be arranged on the other side of the carrier layer so that, when viewing the object in transmitted light, a first moiré pattern is visible while when viewing it in incident light a second moiré image is visible.

Further advantageous effects can be achieved if an UV dyestuff or an IR dyestuff is used for the moiré analyser of the second layer or the moiré pattern of the first layer so that the moiré image is generated only upon irradiation with UV light or upon irradiation with IR radiation. Thus the moiré image becomes visible for example only when viewed under an UV lamp or the moiré image contains an item of machine-readable information which can be evaluated only by means of an IR reading head. A combination of visual and UV/IR moiré images is also possible.

Further advantages can be achieved if a polarisation layer which is shaped in the form of a moiré analyser or moiré pattern is used for the second layer and/or the first layer, so that the moiré image becomes visible only upon being viewed by means of a polariser. Thus different viewing impressions are afforded, depending on whether the value-bearing document is viewed with or without a polariser or in dependence on the angular position of the polariser.

In addition it is also possible for the second layer and/or the first layer to have further functional properties and thus for example form a machine-readable magnetic layer which is shaped in the form of a moiré analyser or moiré pattern, or an antenna which is shaped in the form of a moiré analyser or moiré pattern, for a chip which is integrated in the object of value.

It has proven to be desirable for the first layer containing the moiré pattern to comprise a printable substance which is applied at least region-wise in pattern form in the form of the moiré pattern to the carrier layer. In that respect the printable substance can comprise for example a binding agent and colour pigments or effect pigments, in particular interference layer pigments or liquid crystal pigments. The level of safeguard against forgery is further enhanced by the use of pigments of that nature.

Furthermore the level of safeguard against forgery can be increased by the first layer comprising a partially metallised layer which is shaped at least in region-wise manner in pattern form, in the form of the moiré pattern. Furthermore, to enhance the level of safeguard against forgery, as the first layer, it is possible to use a replication layer in which there is formed a surface structure which has an optical-diffraction effect and in which the moiré pattern is provided.

In accordance with a preferred embodiment of the invention the second layer is part of a transfer layer of a transfer film which is disposed on the first layer or the side of the carrier layer that is in opposite relationship to the first layer. In that arrangement the transfer layer can have a partially metallised metal layer in the form of a moiré analyser. In addition it is also possible for the transfer layer to have a replication layer and a reflection layer, wherein a surface structure having an optical-diffraction effect is formed in the interface between the replication layer and the reflection layer and the reflection layer is shaped at least in region-wise manner in pattern form in the form of a moiré analyser. That affords a security feature with a high level of safeguard against forgery, the optical effect of which can be imitated with other means, only with very great difficulty.

It is further advantageous for one or more layers of the object of value, which have moiré analysers and/or moiré patterns, to be part of a security thread which is disposed on the carrier layer.

In accordance with a further preferred embodiment the value-bearing document can be combined with an additional loose moiré analyser or a loose moiré analyser in accordance with EP 0 930 979 B1.

BRIEF DESCRIPTION OF THE DRAWINGS

The invention is described by way of example hereinafter by means of a number of embodiments with reference to the accompanying drawings.

DETAILED DESCRIPTION OF THE INVENTION

Figure 1:
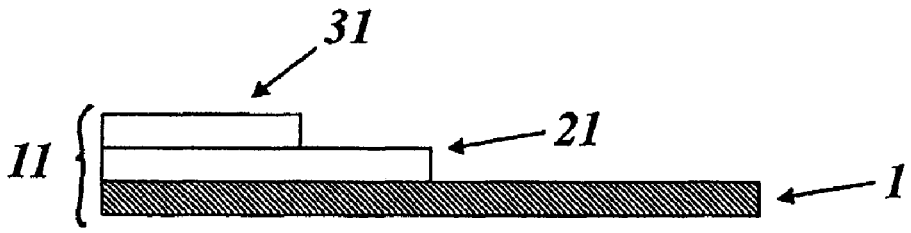
FIG. 1 shows a diagrammatic view of an object of value according to the invention for a first embodiment of the invention.

FIG. 1 shows a portion from a banknote 11 which has a carrier layer 1 and an optical security element which is disposed on the carrier layer and which comprises a layer 21 containing a moiré pattern and a layer 31 containing a moiré analyser.

The carrier layer 1 is formed by the paper or plastic carrier of the banknote 11 and is white or light in terms of its own colour and under some circumstances has printing thereon in the form of drawings or patterns. In addition it will be appreciated that the banknote 11 can have further security features, such as for example watermarks, steel intaglio printing, security threads or luminescent or magnetic printing or the like.

A moiré pattern is a pattern which is formed from repeating structures and which upon superimposition with or in a condition of viewing through a further pattern which is formed by repeating structures and which acts as a moiré analyser, exhibits a new pattern, namely a moiré image, which is concealed in the moiré pattern. In the simplest case that moiré effect arises out of the superimposition of dark and light stripes, wherein regions in which the dark stripes of the moiré pattern and the moiré analyser are one upon the other appear lighter than regions in which the dark stripes of the moiré pattern and the moiré analyser are in mutually juxtaposed relationship. Thus it is possible for example for the moiré pattern to comprise a line grid having a multiplicity of lines at a line spacing in the range of 40 to 200 μm and for that line grid to be phase-shifted in region-wise manner to produce the moiré image. In that respect the phase shift is preferably half a grid period. Such a moiré image can be decoded by means of a moiré analyser which has a line grid with the same line spacing.

Besides a linear line grid it is also possible for the lines of the line grid to have curved regions and to be arranged for example in a wave-shaped or circular configuration. In this case also the moiré image can be encoded by a suitable region-wise phase shift of the curved line grid. Decoding of a moiré image which is concealed in that way is effected by using a suitable moiré analyser which has a line grid corresponding to the line grid of the moiré pattern (without phase shifts). It is possible in that way to permit decoding of the moiré image only by means of a quite special moiré analyser associated with the moiré pattern.

Furthermore it is also possible to use a moiré pattern which is constructed on the basis of two mutually rotated line grids. Decoding of the moiré image in a line grid of that kind is also effected by region-wise phase shift of the line grid, in which respect two different moiré images can be encoded in such a moiré pattern. In that case, the first moiré image can be rendered visible by the use of a first moiré analyser and a second moiré image can be rendered visible by the use of a second moiré analyser or by a different angular positioning of the first moiré analyser.

By the application of those principles, it is then further also possible to encode also more than two moiré images in a moiré pattern, to generate a further moiré pattern by the superimposition of two moiré patterns or to render a moiré image visible by the superimposition of a moiré pattern with two or more moiré analysers. Advantageously in that respect, upon decoding of the respective moiré pattern, care is to be taken to ensure that the area occupation of the moiré pattern is constant in relation to the resolution capability of the human eye so that the information encoded by the phase shift remains invisible to the human viewer without the assistance of a moiré analyser.

Now in a first step the layer 1 is printed on to the paper carrier 1 by means of a printing process, for example by means of steel intaglio printing. The layer 21 thus comprises a printable substrate which preferably comprises a binding agent and colour pigments or effect pigments.

In that case the layer 21 is printed at least in region-wise manner in the form of one of the above-described moiré patterns on to the paper carrier 1. Besides regions which are provided with a moiré pattern the layer 21 can accordingly also include other regions in which other items of image information are represented. Furthermore it is also possible for the external configuration of the layer 21 to represent a symbol or an image object so that, when viewing the layer 21 from a usual viewing distance, for example 30 cm, only that external configuration is apparent to the viewer.

In addition it is also possible for the layer 21 to be applied to the paper carrier 1 by means of a transfer process, for example by hot stamping. In that case the layer 21 preferably comprises a multi-layer transfer layer portion of a hot stamping film which has a protective lacquer layer, a replication layer, a reflection layer which under some circumstances is of a partial nature, and an adhesive layer.

It will be appreciated that it is also possible for the transfer layer portion also to have one or more coloured decoration layers, or to have one or more of such layers instead of the replication layer.

The protective lacquer layer of such a film is preferably of a thickness of 0.3 to 1.2 μm and comprises an abrasion-resistant acrylate. The replication layer preferably comprises a transparent thermoplastic material which is applied to the protective lacquer layer over the full area for example by means of a printing process and then dried. Then a microscopic surface structure is replicated in the replication layer by means of a stamping tool and then the replication layer is hardened possibly by cross-linking or in some other fashion.

A thin reflection layer is then applied to the replication layer. The reflection layer is preferably a thin, vapour-deposited metal layer or an HRI layer (HRI=high reflection index). The materials that can be used for the metal layer are essentially chromium, aluminium, copper, iron, nickel, silver, gold or an alloy with those materials. The materials that can be used for an HRI layer are for example $TiO_2$, ZnS or $Nb_2O_5$. Furthermore, instead of such a metallic or dielectric reflection layer, it is also possible to use a thin film layer sequence comprising a plurality of dielectric or dielectric and metallic layers.

An adhesive layer is then applied to the film body, which adhesive layer for example can comprise a thermally activatable adhesive.

The moiré pattern can be introduced into a layer of that kind for example by the reflection layer being partially metallised or partially demetallised, thus affording a patterned reflection layer shaped in the form of the moiré pattern. In that way the moiré pattern is generated by the reflecting or non-reflecting regions of the layer, the moiré pattern being superimposed by the optical effects generated by the microscopic surface structure. In that connection the microscopic surface structure can be for example a diffractive structure which generates a hologram or a Kinegram®. That structure however can also be an isotropic or an anisotropic matt structure or a macrostructure, for example a microlens structure.

In addition it is also possible for the moiré pattern to be introduced into the configuration of the macroscopic or microscopic surface structure. Thus the surface structure can have for example a background region and an image region which is shaped in accordance with the moiré pattern, wherein different structures are provided in the background region and in the image region, for example different diffractive structures and matt structures, a diffractive structure and a flat (reflecting) surface or a matt structure and a flat (reflecting) surface. A combination of demetallisation and penetration of the moiré pattern into the surface structure is also possible. Furthermore it is also possible for the surface structure to generate a hologram or a Kinegram® which exhibits different moiré patterns at different viewing angles. When using such a surface structure, different moiré images can be generated at different viewing directions.

Furthermore the transfer layer portion, in addition to or instead of the replication layer, can also have a thin film layer system which is shaped in the form of the moiré pattern and which exhibits a colour change effect when the value-bearing document is tilted.

A layer 31 which forms a moiré analyser as described above is now applied to the layer 21.

In accordance with a particularly advantageous embodiment the layer 31 in this arrangement has a thin reflective layer which is shaped at least in region-wise manner in the form of the moiré analyser, in particular a thin metal layer. In that respect, all reflective materials which have already been described hereinbefore in relation to the layer 21 can be used as the reflective layer for the layer 31. Preferably in this case the layer 31 is applied to the layer 21 by means of a transfer process, preferably a hot stamping process. The layer 31 therefore comprises for example a transparent protective lacquer layer, a thin, vapour-deposited and partially metallised metal layer and an adhesive layer.

In addition it is also possible for the layer 31 to comprise a printable substance which can be printed on to the layer 21 by means of a printing process. Furthermore it is also possible for the layer 31 to have a replication layer with a microscopic surface structure formed therein, in which a moiré analyser is provided, as already described hereinbefore in relation to the layer 21.

It is particularly advantageous here to use a moiré pattern and a moiré analyser which is not based on a line grid but on a wavy or specially curved grid or which are based on two or more different grids (see above). That gives rise to particular demands in terms of register accuracy in applying the layer 31 to the layer 21 as just slight differences lead to a change in the moiré image which is produced in the superimposition situation.

As already indicated in FIG. 1 in this case the layer 31 can be superimposed on the layer 21 only in region-wise manner. It is thus possible to provide for the viewer a first region in which the moiré image is visible, a second region in which the image impression is determined by the moiré pattern of the layer 21, and a third region in which the image impression is determined by the moiré analyser of the layer 31. In addition, for example by viewing through a magnifying glass, it is possible to verify that the fine structure of a moiré pattern is present in the second and third regions and the impression which is produced in the first region is generated by the superimposition of those two patterns.

Figure 2:
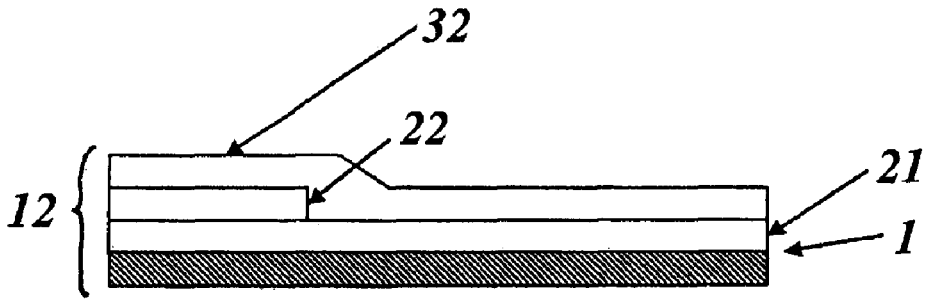
FIG. 2 shows a diagrammatic view of an object of value according to the invention for a second embodiment of the invention.

FIG. 2 shows a banknote 12 which has three layers 21, 22 and 32.

The layers 21 and 22 each involve a respective layer containing a moiré pattern, the moiré patterns of the layers 21 and 22 differing from each other. In this case the layers 21 and 22 can be like the layer 21 shown in FIG. 1. Applied to the layers 21 and 22 is the layer 32 which contains a moiré analyser for the moiré patterns of the layers 21 and 22. In this case the layer 32 preferably comprises a printable substance which is printed on to the layers 21 and 22 for example by means of steel intaglio printing. In principle however in this case the layer 32 can be like the layer 31 of FIG. 1.

The layer 32 includes a moiré analyser for the moiré images of the layers 22 and 21 so that a first moiré image is generated in the region of the moiré pattern of the layer 22 and a second moiré image is generated in the region of the moiré pattern of the layers 21.

It is also possible for superimposition of the patterns of the layer 21, the layer 22 and the layer 32 to occur in the region of the layer 22, in which case, as already described hereinbefore, the moiré patterns of the layers 22 and 21 supplement each other to afford a moiré pattern which contains the moiré image which is rendered visible by the moiré analyser of the layer 32. Thus, for unforged generation of the moiré image in the region of the layer 22 it is necessary for both the layer 22 and also the layer 32 to be applied to the layer 21 in accurate register relationship.

Figure 3:
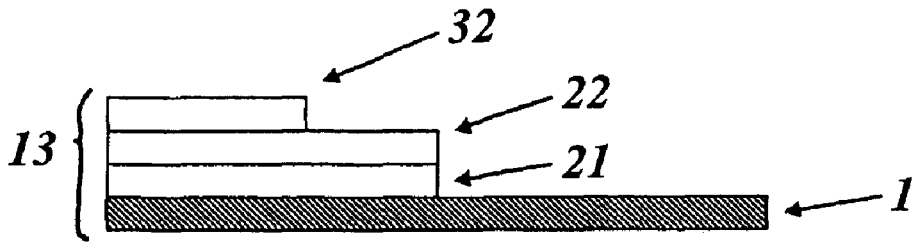
FIG. 3 shows a diagrammatic view of an object of value according to the invention for a third embodiment of the invention.

FIG. 3 shows a banknote 13 which has a carrier layer 1, the layer 21, the layer 22 and the layer 32. In this case the layers 21, 22 and 32 are like the correspondingly identified layers shown in FIG. 1 and FIG. 2.

In the case illustrated in FIG. 3 the moiré pattern contained in the layer 22, in the region in which the layer 22 is not covered by the layer 32, acts as a moiré analyser for generation of the moiré image contained in the layer 21. The effects described in relation to the embodiment of FIG. 2 are produced in the region in which the layer 22 is covered by the layer 32.

Figure 4:
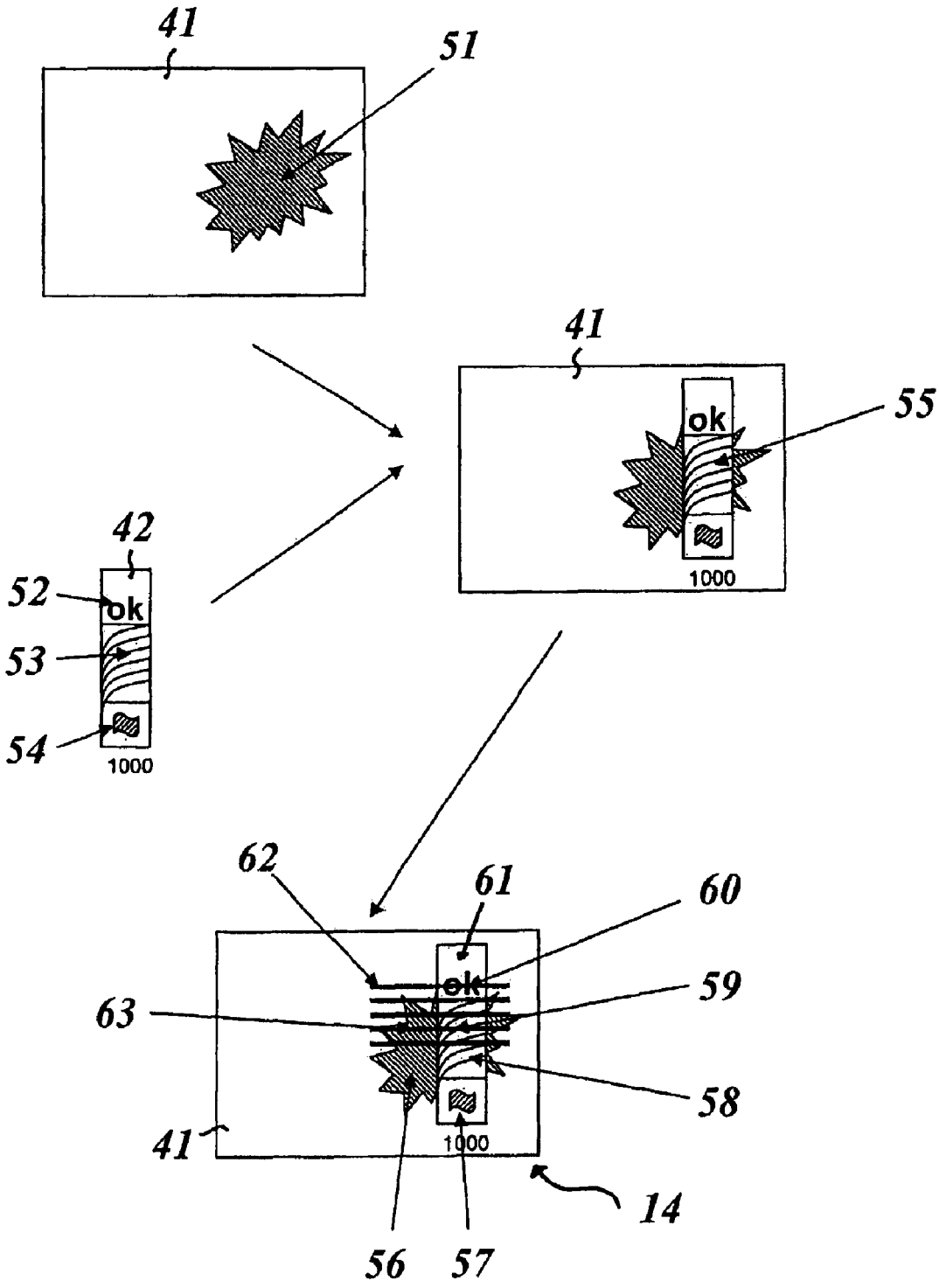
FIG. 4 shows a functional representation illustrating production and structure of an object of value according to the invention.

FIG. 4 shows a further combination of applications of the above-discussed principles:

FIG. 4 shows a banknote 41, on the paper carrier of which a moiré pattern is applied by printing in a region 51. Then, applied to the banknote 41 is an optical security element 42 which comprises a transfer layer portion of a transfer film, in particular a hot stamping film. The optical security element 42 has a first region 52 which contains a Kinegram® and a diffractive pattern. The optical security element 42 further has a region 53 having a Kinegram® which is partially demetallised in accordance with a further moiré pattern. The optical security element 42 also has a region 54 which contains a Kinegram® but no moiré pattern.

Figure 5A:
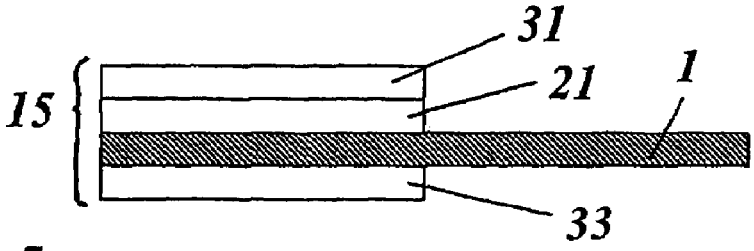
FIGS. 5*a* to 5*c* show diagrammatic views to illustrate the structure and the mode of operation of an object of value according to the invention.

In this case, as already described in relation to the layer 21 shown in FIG. 5*a*, the optical security element 42 is made up of a replication layer, a reflecting layer and an adhesive layer, wherein shaped into the interface layer between the replication layer and the reflective layer is a diffractive surface structure which permits generation of the Kinegrams.

After application of the optical security element 42 to the carrier 41, the region 55 comprises a superimposition of the moiré pattern which is applied by printing, with the moiré pattern which is introduced in the region 53, so that a moiré image is generated in that region.

Then the security element 42 and the moiré pattern applied by printing in the region 51 is overprinted with a moiré pattern acting as a moiré analyser, thus giving the banknote 14 shown in FIG. 4. The following viewing impression is afforded here in the regions 56 to 63 of the banknote 14:

In the region 56 the viewer perceives a star-shaped printing configuration which contains a moiré pattern which in itself is not visible. In the regions 57 and 61 the viewer perceives a respective Kinegram®.

In the region 58 the viewer perceives a first moiré image which arises out of the superimposition of the moiré pattern of the region 51 and the moiré analyser of the region 53. In the region 63 the viewer perceives a second moiré image which arises out of the superimposition of the moiré pattern of the region 56 and the last-printed moiré analyser.

In the region 59 the viewer sees a third moiré image which arises out of the superimposition of the moiré pattern 56, the moiré pattern of the region 53 and the last-printed moiré analyser.

In the region 60 the viewer sees a fourth diffractive moiré image which arises out of the superimposition of the moiré pattern of the region 52 with the last-printed moiré analyser.

A further embodiment by way of example of the invention will now be described with reference to FIGS. 5*a* to 5*c*.

FIG. 5*a* shows a banknote 15 which comprises the carrier 1, the layer 21, the layer 31 and a layer 33. The layers 21 and 31 are like the layers 21 and 31 shown in FIG. 1, that is to say the layer 21 contains a moiré pattern and the layer 31 contains a moiré analyser. The layer 33 is like the layer 22 shown in FIG. 2 and contains a moiré pattern which acts as a moiré analyser or as a moiré pattern superimposed on the moiré pattern 21. In the embodiment shown in FIG. 5*a* the carrier 1 is transparent or semitransparent at least in the region in which the layer 21 is applied.

Figure 5B:
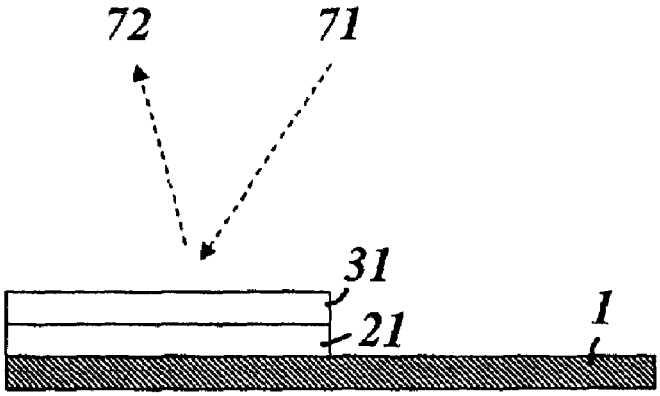

When viewing the arrangement in incident light, the result is the effect shown in FIG. 5*b*:

Incident light 71 passes through the layers 31 and 21, is reflected and then determines the impression given to the viewer. Here there is the effect already described with reference to FIG. 1, that a moiré image 72 becomes visible to the viewer, that image being determined by the superimposition of the moiré pattern of the layer 21 and the moiré analyser of the layer 31.

Figure 5C:
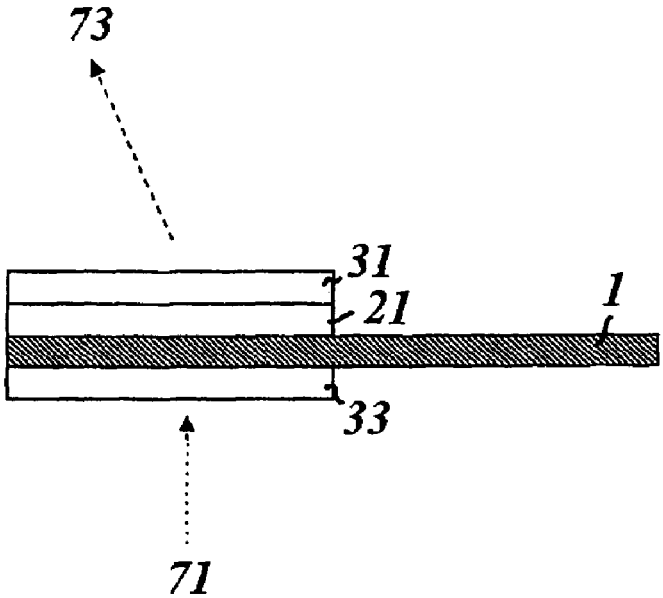

The effect shown in FIG. 5*c* is produced when viewing in transmitted light:

The incident light 71 passes through the layers 31, 1, 21 and 31, so that the viewer sees a moiré image 73 which is produced by the superimposition of the moiré patterns of the layers 33 and 21 and the moiré analyser 31.

It is also possible for a further layer which contains a moiré analyser to be applied to the layer 33. Accordingly, when viewing in incident light from the first side a first moiré image becomes visible, when viewing in incident light from the other side a second moiré image becomes visible and when viewing in transmitted light a third moiré image becomes visible.

Further embodiments by way of example of the invention will now be described with reference to FIG. 6 and FIG. 7.

Figure 6:
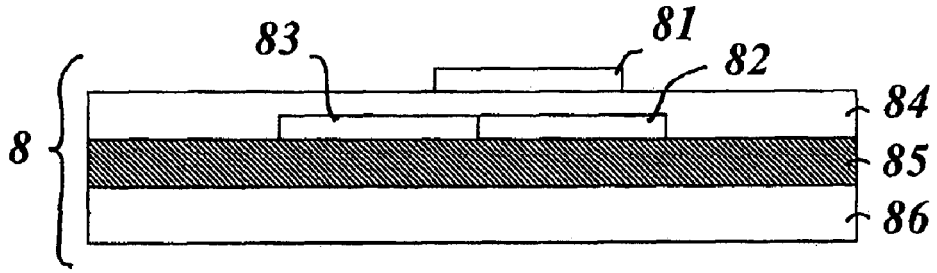
FIG. 6 shows a diagrammatic view of a polycarbonate card which has an internally disposed Kinegram™.

FIG. 6 illustrates by way of example the structure of a polycarbonate card which can be used for example as an identity card, money, value or check card. That polycarbonate card has an internally disposed Kinegram®.

FIG. 6 shows a card 8 which has a carrier body 85, two protection layers 84 and 86 and a layer which is disposed region-wise on the carrier body 85, with a first layer region 83 and a second layer region 82, and a layer 81.

The carrier body 85 is a polycarbonate core which is printed with a moiré pattern.

The layer with the regions 82 and 83 has a replication layer with a diffractive structure formed therein, wherein a first transparent Kinegram is generated by that diffractive structure in the region 83 and a second transparent Kinegram is generated in the region 82. That layer thus for example comprises the transfer layer of a hot stamping foil which has that replication layer as well as an adhesive layer with a refractive index differing from the replication layer.

The layer 81 comprises an imprint which is shaped in the form of a moiré analyser.

In this case the Kinegrams in the regions 82 and 83 are so selected that, in dependence on the angle of view, they show two or more different moiré patterns. Depending on the angle of view at which a viewer views the card 8, the one or the other of those moiré patterns is accordingly superimposed in the region 83 with the moiré pattern of the film body 85 so that the viewer sees moiré images which are different in dependence on the angle of view. In the region 82 the moiré patterns of the layer 81, the carrier body 85 and the Kinegram generated in the region 82 are in mutually superposed relationship so that here too there are moiré patterns which are different in dependence on the angle of view. If, as shown in FIG. 6, the printing of the layer 81 is not effected in accurate register relationship with the region 82, the result is further partial regions in which further moiré images become visible.

Figure 7:
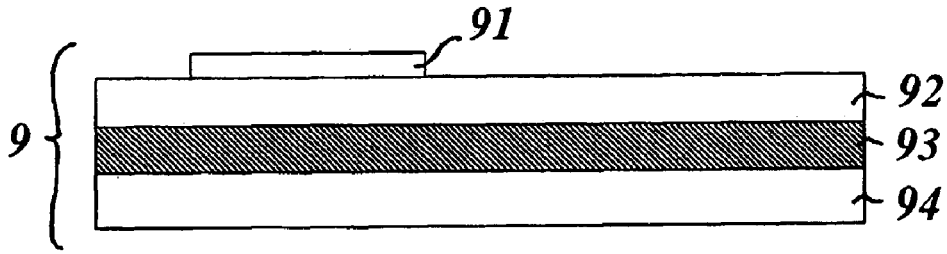
FIG. 7 shows a diagrammatic view of a polycarbonate card which has a Kinegram™ applied to the surface.

FIG. 7 now shows by way of example the structure of a polycarbonate card which has a Kinegram applied to the surface.

FIG. 7 shows a layer 91, two protection layers 92 and 94 and a carrier body 93.

The carrier body 93 comprises a polycarbonate core on which a moiré pattern is printed.

The layer 91 comprises for example the transfer layer of a hot stamping film which has an adhesive layer, a replication layer and a protection layer, wherein a diffractive structure generating a Kinegram is shaped between the replication layer and the adhesive layer. In the region of that diffractive structure a transparent Kinegram is thus generated by the layer 91. That Kinegram has the properties already described in relation to FIG. 6, of providing two or more different moiré patterns in dependence on the angle of view. Those moiré patterns serve as moiré analysers for the moiré pattern which is printed on the carrier body 93 so that different moiré images are visible in dependence on the angle of view in the region of the layer 91.

The invention claimed is:

1. An object of value comprising:

a carrier layer, at least one optical security element which is disposed on the carrier layer and which has a first layer containing a moiré pattern, and two or more secondary layers which each contain a respective moiré analyzer for the moiré pattern of the first layer, and a first secondary layer is arranged on the same side of the carrier layer as the first layer and a second secondary layer is arranged on the opposite side of the carrier layer so that a first moiré image is visible when viewed in transmitted light and a second moiré image is visible when viewed in incident light, wherein a pattern formed by repeating structures acts as the moiré analyzer.

2. The object of value according to claim 1, wherein the first layer comprises a printable substance which is disposed at least in region-wise fashion in pattern form in the form of the moiré pattern, in particular on the carrier layer.

3. The object of value according to claim 2, wherein the printable substance comprises binding agent and color pigments or effect pigments, in particular interference layer pigments or liquid crystal pigments.

4. The object of value according to claim 1, wherein the first layer comprises a partially shaped metal layer, wherein the metallized or non-metallized regions of the metal layer are shaped in at least region-wise fashion in pattern form in the form of the moiré pattern.

5. The object of value according to claim 1, wherein the first layer comprises a replication layer in which a surface structure having an optical-diffraction effect is shaped, the moiré pattern being introduced into the surface structure.

6. The object of value according to claim 5, wherein the surface structure having an optical-diffraction effect contains a hologram or a kinegram which shows moiré patterns which differ from different viewing angles so that different moiré images are generated in different viewing directions.

7. The object of value according to claim 1, wherein the first layer comprises a partially shaped thin film layer system which produces a color change effect by means of interference, wherein the thin film layer system is shaped at least in region-wise manner in pattern form in the form of the moiré pattern.

8. The object of value according to claim 1, wherein one of the secondary layers comprises a printable substance which is disposed at least in region-wise fashion in pattern form in the form of the moiré analyzer, in particular on the first layer or the side of the carrier layer which is in opposite relationship to the first layer.

9. The object of value according to claim 8, wherein the printable substance contains ultraviolet (UV) color pigments or infrared (IR) color pigments so that the moiré image is generated only upon irradiation with UV radiation or upon irradiation with IR radiation.

10. The object of value according to claim 1, wherein the first and/or one of the secondary layers comprises a partially shaped polarization layer, wherein the polarization layer is shaped at least in region-wise manner in pattern form in the form of the moiré analyzer or the moiré pattern.

11. The object of value according to claim 1, wherein the first secondary layer or the second secondary layer is part of a transfer layer of a transfer film.

12. The object of value according to claim 11, wherein the transfer layer has a partially shaped metal layer, wherein the metallized or non-metallized regions of the metal layer is shaped at least in region-wise manner in pattern form in the form of the moiré analyzer.

13. The object of value according to claim 11, wherein the transfer layer has a replication layer and a reflection layer, in particular a metal layer, wherein a surface structure having an optical-diffraction effect is shaped into the interface between the replication layer and the reflection layer and the reflection layer is shaped at least in region-wise fashion in pattern form in the form of the moiré analyzer.

14. The object of value according to claim 1, wherein the object of value has a loose moiré analyzer which is not arranged in a fixed position relative to the first layer and the second layer and which is so designed that a moiré image is generated when the loose moiré analyzer is brought into overlapping relationship with the first and/or the second layer.

15. The object of value according to claim 1, wherein the carrier layer is a transparent or semi-transparent.

* * * * *

UNITED STATES PATENT AND TRADEMARK OFFICE

CERTIFICATE OF CORRECTION

PATENT NO. : 7,654,579 B2
APPLICATION NO. : 10/589178
DATED : February 2, 2010
INVENTOR(S) : Achim Hansen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 339 days.

Signed and Sealed this

Twenty-eighth Day of December, 2010

David J. Kappos

David J. Kappos
*Director of the United States Patent and Trademark Office*